US006070352A

United States Patent [19]

Daigle

[11] Patent Number: 6,070,352

[45] Date of Patent: Jun. 6, 2000

[54] FIREARM MAGAZINE CARTRIDGE CONVERTER

[75] Inventor: Arthur F. Daigle, Plymouth, Conn.

[73] Assignee: Colt's Manufacturing Company, Inc., Hartford, Conn.

[21] Appl. No.: 09/190,693

[22] Filed: Nov. 12, 1998

[51] Int. Cl.[7] ..... F41A 9/61

[52] U.S. Cl. ..... 42/49.02

[58] Field of Search ..... 42/18, 50, 49.02

[56] References Cited

U.S. PATENT DOCUMENTS

| | | | |
|---|---|---|---|
| 1,407,633 | 2/1922 | Burton | 42/50 |
| 2,396,816 | 3/1946 | Boudreau | 42/50 |
| 2,507,364 | 5/1950 | Benson | 42/50 |
| 2,956,363 | 10/1960 | Montana | 42/50 |
| 3,110,122 | 11/1963 | Musgrave | 42/50 |
| 3,345,771 | 10/1967 | Silsby | 42/16 |
| 3,603,020 | 9/1971 | Wiese | 42/50 |
| 3,771,415 | 11/1973 | Into et al. | 89/16 |
| 3,772,812 | 11/1973 | Day | 42/7 |
| 3,776,095 | 12/1973 | Atchisson | 89/128 |
| 4,058,922 | 11/1977 | Elbe et al. | 42/16 |
| 4,069,608 | 1/1978 | Jurek | 42/49 |
| 4,079,535 | 3/1978 | Elbe et al. | 42/49 A |
| 4,139,958 | 2/1979 | Foote | 42/49 |
| 4,169,329 | 10/1979 | Atchisson | 42/16 |
| 4,194,314 | 3/1980 | Foote | 42/25 |
| 4,220,071 | 9/1980 | Seiderman | 89/128 |
| 4,297,800 | 11/1981 | Atchisson | 42/49 A |
| 4,586,281 | 5/1986 | Chesnut | 42/50 |
| 5,072,537 | 12/1991 | Velezis | 42/18 |
| 5,153,359 | 10/1992 | Lishness | 42/50 |
| 5,379,541 | 1/1995 | Bammate | 42/7 |
| 5,416,998 | 5/1995 | Martel | 42/6 |
| 5,520,019 | 5/1996 | Schuetz | 42/49.02 |
| 5,566,488 | 10/1996 | Yap | 42/49.02 |
| 5,628,134 | 5/1997 | Wesp et al. | 42/7 |
| 5,761,841 | 6/1998 | Snick | 42/50 |

OTHER PUBLICATIONS

"Colt Sub Guns For Cops" May 1993 (6 pages) Gun World.
Colt Model 635 Fact Sheet.
Colt Model 633HB Fact Sheet.
Colt Model R6700 Model 6222 picture 223 REM.

*Primary Examiner*—Charles T. Jordan
*Assistant Examiner*—Jeffrey Howell
*Attorney, Agent, or Firm*—Perman & Green, LLP

[57] ABSTRACT

An adapter for converting the receiver of a rifle to one which receives a cartridge housing rounds of a shorter length, said adapter comprises a body defined by four walls two of which walls defining the front and rear walls of the adapter and two of which walls defining left and right side walls of the adapter. Each of said walls defining a secondary receiver chamber sized to receive a magazine cartridge of rounds a shorter length than otherwise provided for in a rifle. The adapter includes a mechanism which cooperates with a retention catch of a rifle to effect registration of the adapter with the rifle and for allowing the magazine cartridge to be releasably connected to the adapter.

18 Claims, 10 Drawing Sheets

FIREARM MAGAZINE CARTRIDGE CONVERTER

TECHNICAL FIELD

The technical field of this invention relates to firearms and more particularly to an improvement in a means for adapting a different caliber sized magazine cartridge for firing in a firearm.

PRIOR ART

| | |
|---|---|
| 1,407,633 | F. F. Burton |
| 2,396,816 | J. L. Boudreau |
| 2,507,364 | C. H. Benson |
| 3,110,122 | D. D. Musgrave |
| 3,776,095 | Atchisson |
| 4,069,608 | Jurek |
| 4,079,535 | Elbe et al. |
| 4,139,958 | Foote |
| 4,586,281 | Chesnut |
| 5,153,359 | Lishness |
| 5,566,488 | Yap |
| 5,761,841 | Snick |

BACKGROUND OF THE INVENTION

The present invention relates to an improvement in a conversion kit for allowing a 5.56 mm NATO or 7.62×39 AR-15 or M-16 rifle to fire a 9 mm parabellum equivalent. Conversion kits for converting a M16 rifle for firing a 9 mm round are known. Such kits include a barrel replacement assembly which quite readily can be replaced for the standard M-16 round. However, the conversion of such a M-16 rifle further must include a more evasive change in the structure of the magazine receiver.

As illustrated in the prior art showing of FIG. 3, a lower receiver frame, such as provided for in an M-16 rifle is illustrated as generally 1, was modified by using front and rear mounting adapter plates 4 and 6 which were secured through adapter pins 8, 8 slid transversely through the rifle frame 2 and into the respective adapter plates. This process involved the custom forming of drill holes through the frame and the aligning of respective ones of the adapter plates with these holes to secure each of the plates within the magazine receiver. However numerous problems associated with this type of modification were prevalent. First, since the process involved aligning and drilling each frame to be individually adapted to receive the pins 8,8, the possibility for error as between one frame and the other was high. Thus, the initial process of conversion to a short round magazine was a highly involved process requiring detailed attention of a skilled worker. Additionally, even after this was done, such prior art kits were not very well adapted for field conversion requiring the insertion of the small securement pins through the drill holes once alignment could be made. Another drawback to such prior art systems, as can be seen from FIG. 3, was that the adapter plates 4,6 only provided bearing surfaces for the front and rear sides of the smaller round cartridge used. This contributed to a somewhat unstable condition when the short round magazine cartridge was situated within the magazine receiver.

Accordingly, an object in the invention to provide an adapter for a rifle enabling it to fire a shorter round and which adapter is capable of being readily inserted to the receiver of the rifle without use of pins or other like fastening devices which need to be aligned with one another.

Still a further object of the invention is to provide an adapter the aforementioned height which is capable of receiving a standard magazine cartridge of a shorter length.

A further object of the invention is to provide a conversion adapter of the aforementioned height wherein the standard cartridge release is capable of being used for removably inserting a standard 9 mm magazine cartridge repeatedly into and out of the rifle receiver.

It is still a further object of the invention to provide a converter adapter which is capable of using the spring energies found within the magazine cartridge and the rifle bolt catch to effect bolt blocking.

Still a further object of the invention is to provide a converter adapter of the aforementioned type wherein the cartridge is supported on four sides.

Further objects in advantages of the invention will become apparent from the following detailed description and the amended claims.

SUMMARY OF THE INVENTION

In the invention resides in an adapter used for receiving a magazine of shorter length rounds than standardly used in a rifle. The adapter comprises a body defined by four walls two of which walls defining front and rear walls of the adapter and two of which walls defining left and right side walls of the adapter. Each of the walls defining a secondary receiver chamber sized to receive a magazine cartridge of rounds shorter in length than otherwise provided for in a rifle. Means is provided for cooperating with a retention catch of a rifle to effect registration of the adapter with the rifle and for allowing the magazine cartridge to be releasably connected to the adapter.

Ideally, the means for cooperating with a retention catch includes a through opening formed in one of the side walls of the adapter and one side wall having a thickness smaller than the length of the catch of a rifle such that a portion of the catch extends through the one of the side walls and into the secondary receiver chamber.

Additionally, the means for cooperating with the retention catch further including means for securing the adapter in place within the secondary receiver chamber when the magazine catch of a rifle is moved out of the through opening of the adapter.

Desirably, the securing means includes a pair of biassing members housed partially within the front wall of the adapter and being movable outwardly to positions extending beyond the right and left side walls by a internal biasing means housed within the front wall and the internal biasing means including a threaded opening formed within the front wall extending parallel thereto and intersecting perpendicularly transverse openings in which are housed each of the biassing members, and wherein the threaded opening receiving a threaded member therein.

Preferably, the threaded member has a portion on which threaded surfaces are formed and an upper portion engageable with a ball member, each of the biassing members having a tapered surface in engagement with the ball member to equally distribute a holding force to the biassing members and the adapter is formed from a metallic extrusion such that each the four side walls is integrally formed with one another.

In the preferred embodiment, the adapter includes an adapter bolt catch received slidably within a generally rectangular shaped recess extending vertically perpendicularly to a central axis of the adapter, and the adapter bolt catch has an elongate portion which is adapted sizewise and lengthwise to be received within the rectangular shaped recess in the adapter.

Preferably, the adapter bolt catch has an elongate slot which is correspondingly sized and shaped to received a locating pin which is secured into the rear end wall of the adapter to limit vertical movement of the adapter bolt catch and the adapter bolt catch further includes a forwardly directed projection which is cantilevered into the secondary receiver chamber and a rearwardly projection having a engagement surface which is generally horizontally disposed relative to the elongate extent of the elongate portion.

The invention further resides in a method of using the adapter by positioning the adapter within the receiver of a rifle such that the top engagement surface of the adapter bolt catch sits below the rifle bolt catch projection of a rifle when the adapter is inserted into the receiver in registration with the firing chamber of a rifle and using the spring action of the spring in a magazine cartridge to move the adapter bolt catch upwardly to interrupt the movement of the rifle bolt returning to the firing chamber after the last round is expended.

Ideally, the adapter bolt catch is caused to be biased downwardly by the controlling downward bias of a rifle catch spring acting through a catch projection of the rifle situated above the rearward projection and the spring force of a magazine cartridge inserted into the adapter being selected to be greater than that of the rifle bolt catch so as to cause the adapter bolt catch to be driven upwards and inturn counter rotate the rifle bolt catch so as to position the rifle bolt catch stop face in blocking engagement with the returning bolt to prevent it from entering the firing chamber once the last round of the cartridge has been expended.

DETAILED DESCRIPTION OF THE PREFERRED EMBODIMENT

Figure 1:
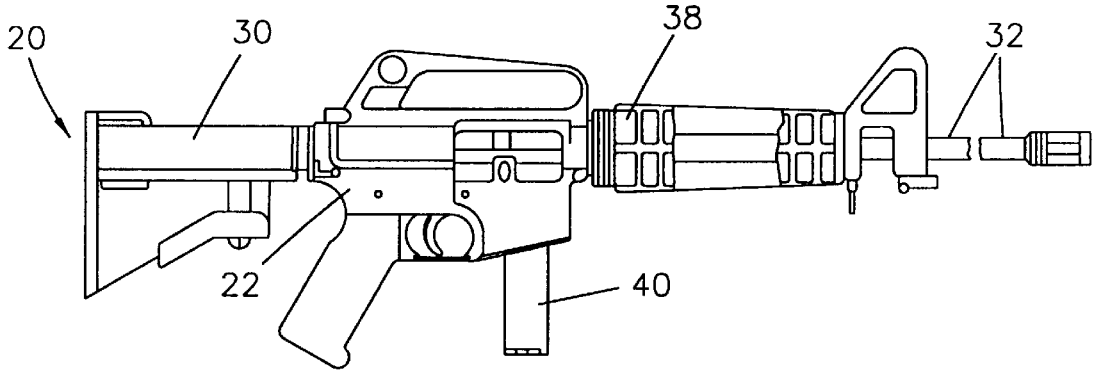
FIG. 1 PRIOR ART
FIG. 1 is a side elevation view of a rifle of the type in which the invention is used.
Figure 2:
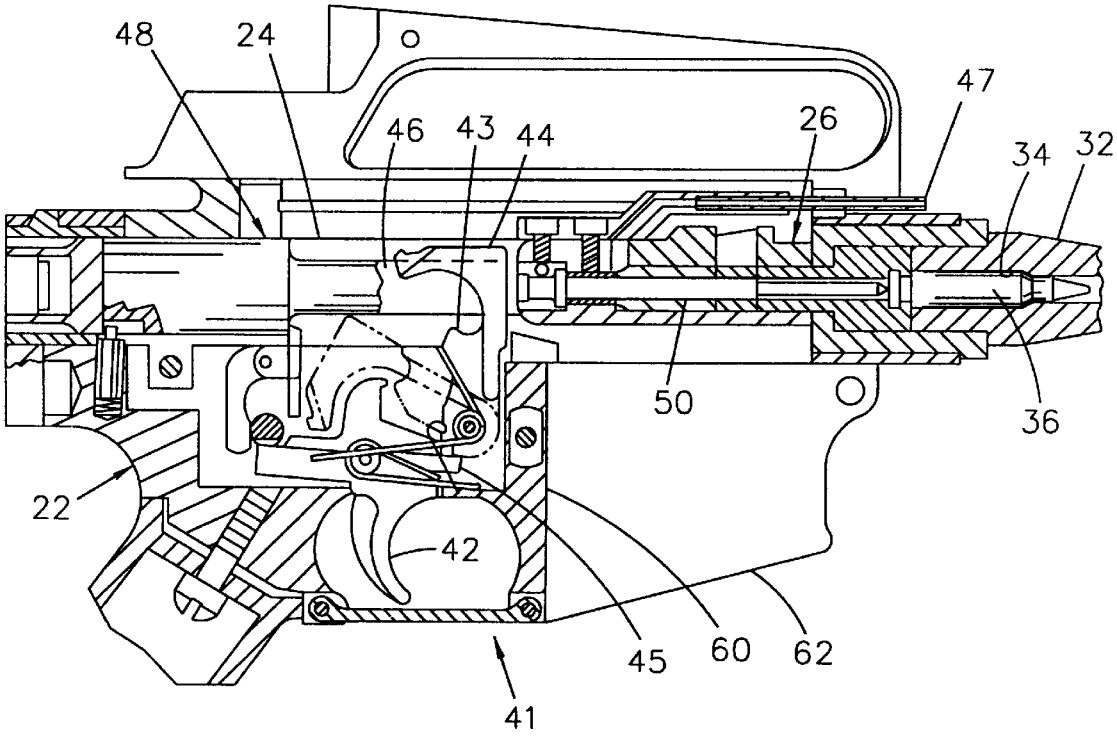
FIG. 2 PRIOR ART
FIG. 2 is a partial fragmentary vertical sectional view through the rifle of FIG. 1
Figure 3:
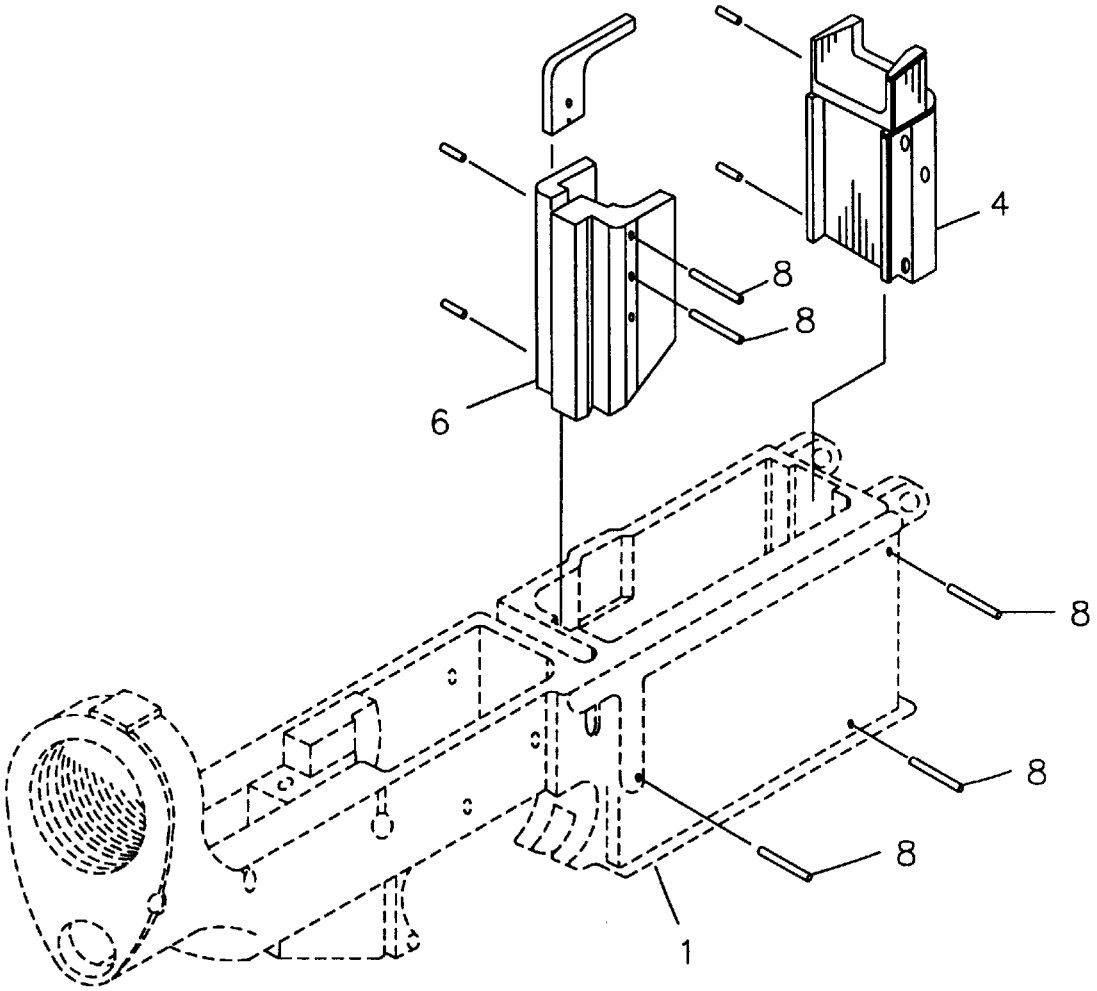
FIG. 3 is a perspective view showing the prior art conversion kit in solid line and the receiver frame in phantom line.

FIGS. 1 and 2 illustrate an automatic firearm 20 of the gas operated type. The firearm 20 depicted is of a known design and may be, for example, an M16 rifle commonly used by the United States military personnel. It comprises a receiver assembly 22, having an upper chamber 24 for receiving a bolt assembly 26. The receiver includes a receiver extension which is rigidly connected with a stock 30. Operatively connected forwardly of the chamber 24 is a barrel 32 having a firing chamber 34 in which is positioned a cartridge 36. A hand grip 38 is mounted on the barrel for isolating the user from direct contact with the barrel.

A trigger mechanism 41 is provided and is generally similar to that which is discussed in U.S. Pat. No. 3,236,155. Generally speaking, it should be seen that upon pulling of a trigger 42, a spring biased hammer 44 is released after a trigger sear 45 is dislodged from a disconnect surface 43 on the hammer. This enables the hammer to rotate clockwise through a slot in a bolt carrier 48 to strike firing pin 50 to fire the cartridge 36. Thereupon, a portion of the expanded gases developed on firing of the firearm passes through a gas port in the barrel at the front of the site, through the gas tube 47 and through a gas passable 54 on the bolt carrier to actuate the automatic recoil of the cartridge shell and subsequent successive chambering of cartridges 36 and in the cartridge magazine 40 as the bolt carrier returns to the battery position after recoil.

Figure 5:
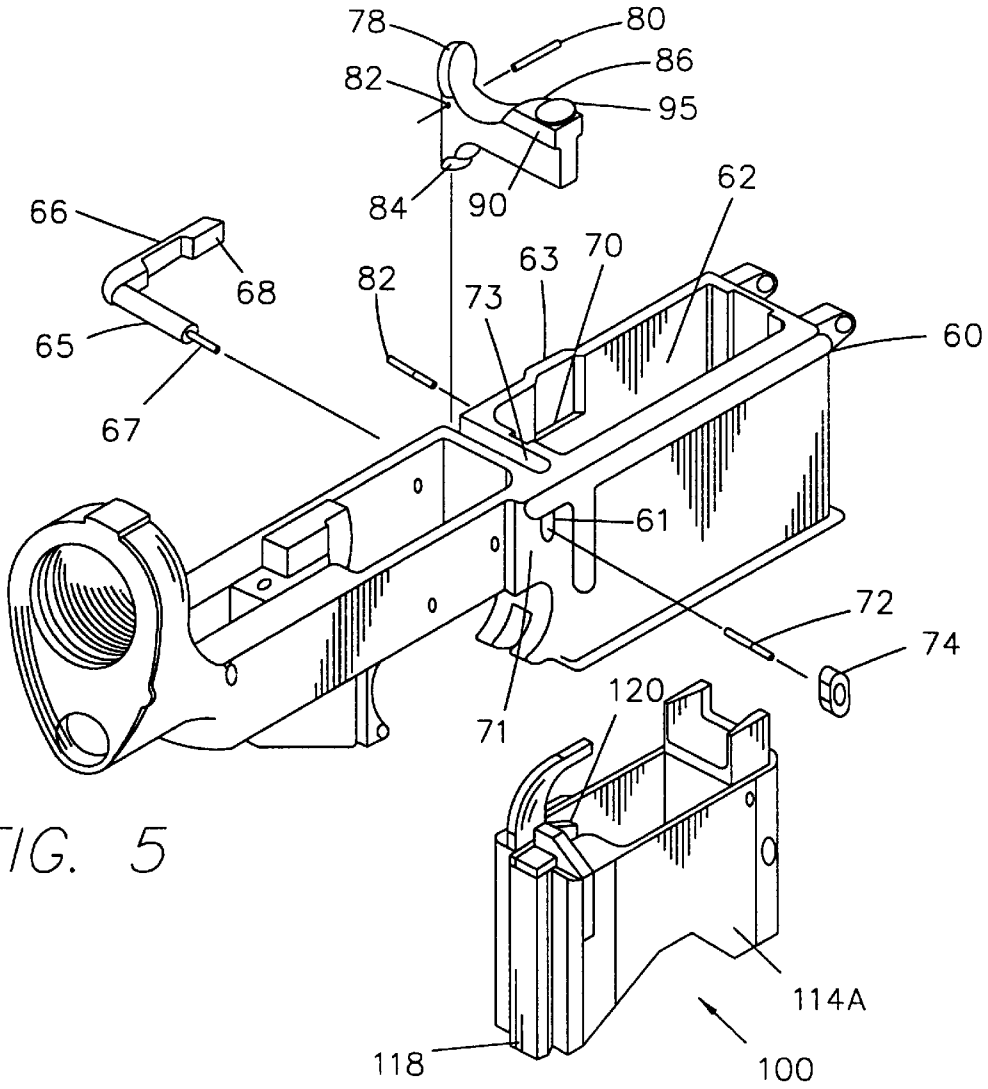
FIG. 5 is a perspective view of the rifle upper receiver with the adapter shown apart from the receiver well in a preinsertion position.
Figure 6:
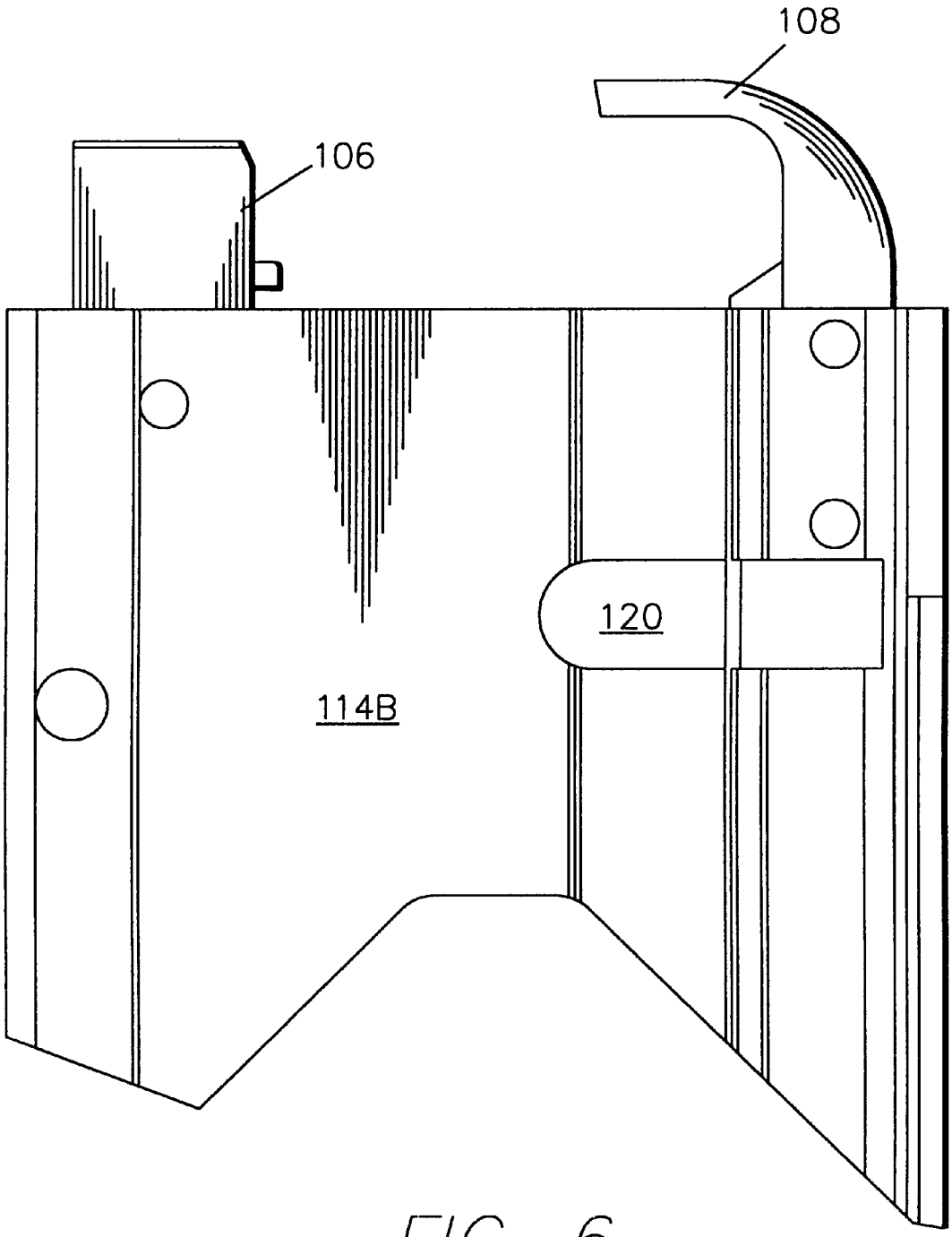
FIG. 6 is a side elevation view of the adaptor looking at it from the left.

As illustrated in FIGS. 2 and 5, the receiver assembly 22 is defined by a receiver frame 60 defining a receiver chamber 62 for receiving the magazine cartridge 40 therein. As illustrated, the upper receiver frame 60 further includes a transverse bore 61 into which is received a cylindrical portion 65 of a magazine catch 66. The magazine catch further includes an inwardly directing end 68 which is correspondingly sized and shaped to be received within a corresponding catch opening 70 formed through the side wall 63 of the receiver 60. The catch is normally biased to a closed position, i.e. drawn up against the outer surface of the side wall 63 of the receiver 60 through the intermediary of an expansion spring 72 coaxially disposed about the free end 67 of the cylindrical portion 65 of the catch 66. A button 74 is fixably secured to the free end 67 of the catch 66 and captures the expansion spring 72 between it and the opposite side wall 71 of the receiver frame 60.

The receiver frame 60 additionally includes an inwardly directed slot-like recess 76 which opens to and extends perpendicularly from the side wall 63 of the receiver frame and terminates in an end wall 73 within the frame 60. The recess 76 is correspondingly sized and shaped to receive a bolt catch member 78 so as to allow it to be pivotally mounted within the recess 76 through the intermediary of a bolt catch pin 80 received through a pivot opening 82 formed in the bolt catch member 78 and secured to the frame within a locating opening disposed therein (not shown) and oriented perpendicularly to the elongate extent of the recess 76. The bolt catch 78 is normally rotationally biased in a clockwise direction, i.e. toward the receiver frame 60, through the intermediary of a biasing spring 82 which acts between the end wall 73 of the recess 76 and an opposing face 84 on the catch 78.

The catch 78 further has a pall 86 which has a forwardly directed tip 85 extending toward the barrel so as to partially overhang into the receiver chamber 62 when the catch is pivotally located within the recess 76. As is standardly understood, the tip 85 of the pall so extends outwardly into the chamber 62 as to coact with a cartridge follower which is biased toward it by the magazine cartridge spring to a topmost position and engages with it at the expenditure of the last round. In so doing, the follower, as it is known, strikes the pall 86 thereby otherwise counterrotating the catch 78 in a counterclockwise direction and thereby raising the catch to present stop face 90 to abut the returning leading frontal end of the bolt carrier 48 simultaneously with the discharge of the last expended shell of the magazine clip.

Figure 4:
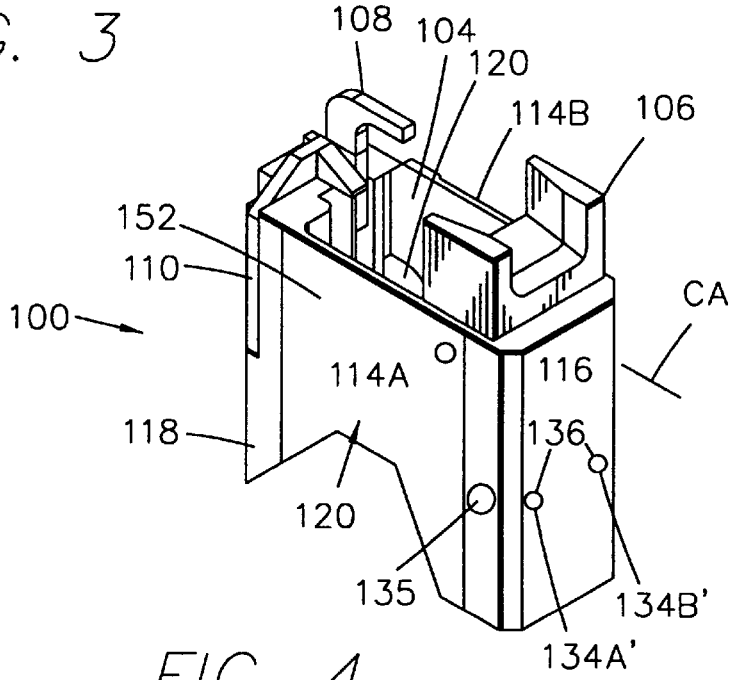
FIG. 4 is a front perspective view of the adaptor of the invention.

In accordance with the invention as illustrated in FIG. 4, an adapter referenced generally as 100 is provided. The adapter 100 includes an adapter body 102 defining a secondary receiver chamber 104 and includes a bullet ramp 106 disposed at the end of the adapter associated with the barrel 32 secured to the adapter body 102 by a transverse pin 31 extending through the stem of the ramp and fixed within a corresponding aligned opening in the adapter body 102. The adapter 100 further includes an ejector 108 which is fixably attached to the adapter body 102 and includes an adapter bolt catch 110 which is vertically slidably connected to the body 102 within a correspondingly sized and shaped recess formed therewithin to prevent the bolt 48 from extension into the chamber once the last round of the cartridge is fired. A means 112 (see FIG. 9) is also provided as part of the adapter 100 for causing the adapter body 102 to be immovably secured within the receiver 30 of the rifle 20 independently of the action of magazine catch 66.

Figure 8:
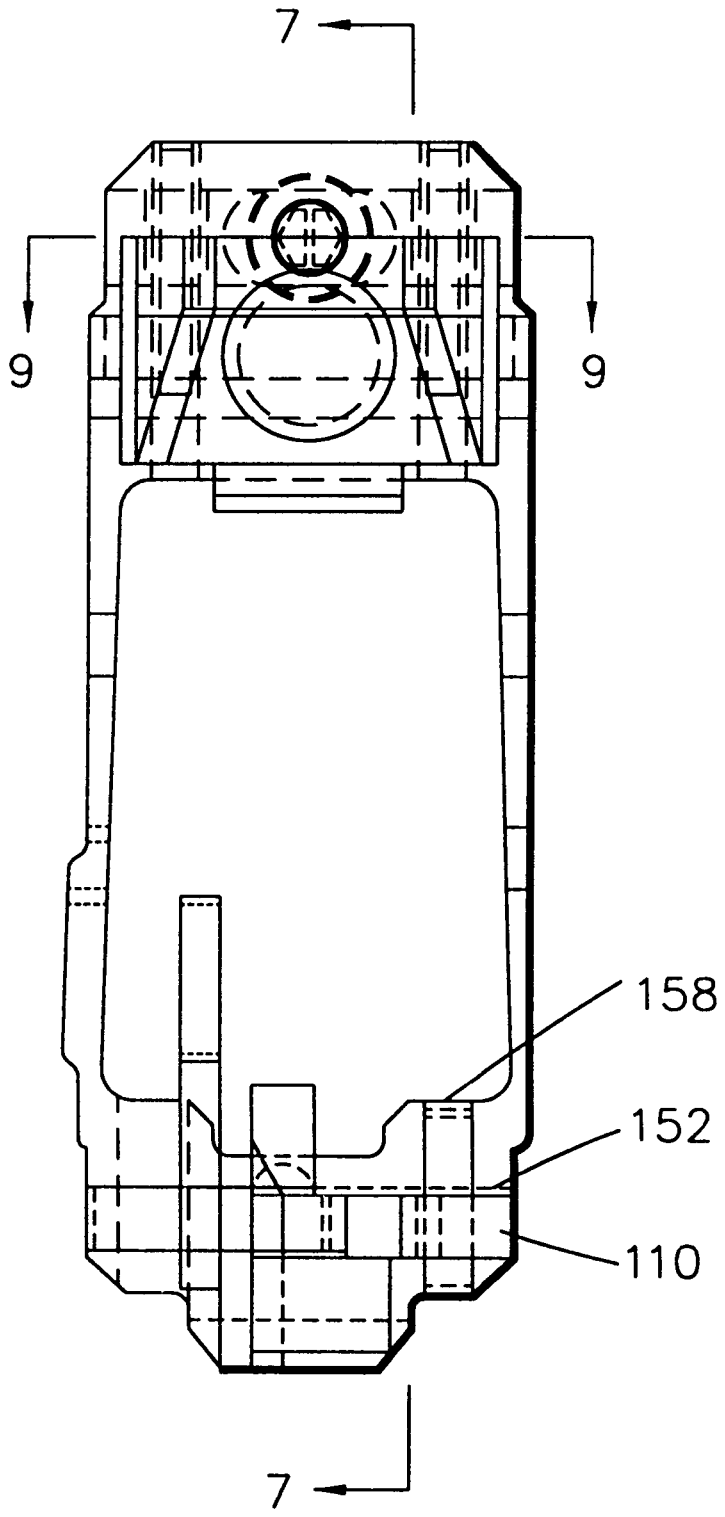
FIG. 8 top plan view of the adapter.

Referring again to FIGS. 4 and 5, it should be seen that the adapter body 102 is formed from a high strength metal, such as aluminum, as a four-sided extruded rectangular member (as seen from top view in FIG. 8) having side walls 114*a* and 114*b* which extend parallel to the length of the rifle 20 and to a central axis CA, and end walls 116 and 118 each respectively associated with the front and the rear end of the rifle 20.

Figure 13:
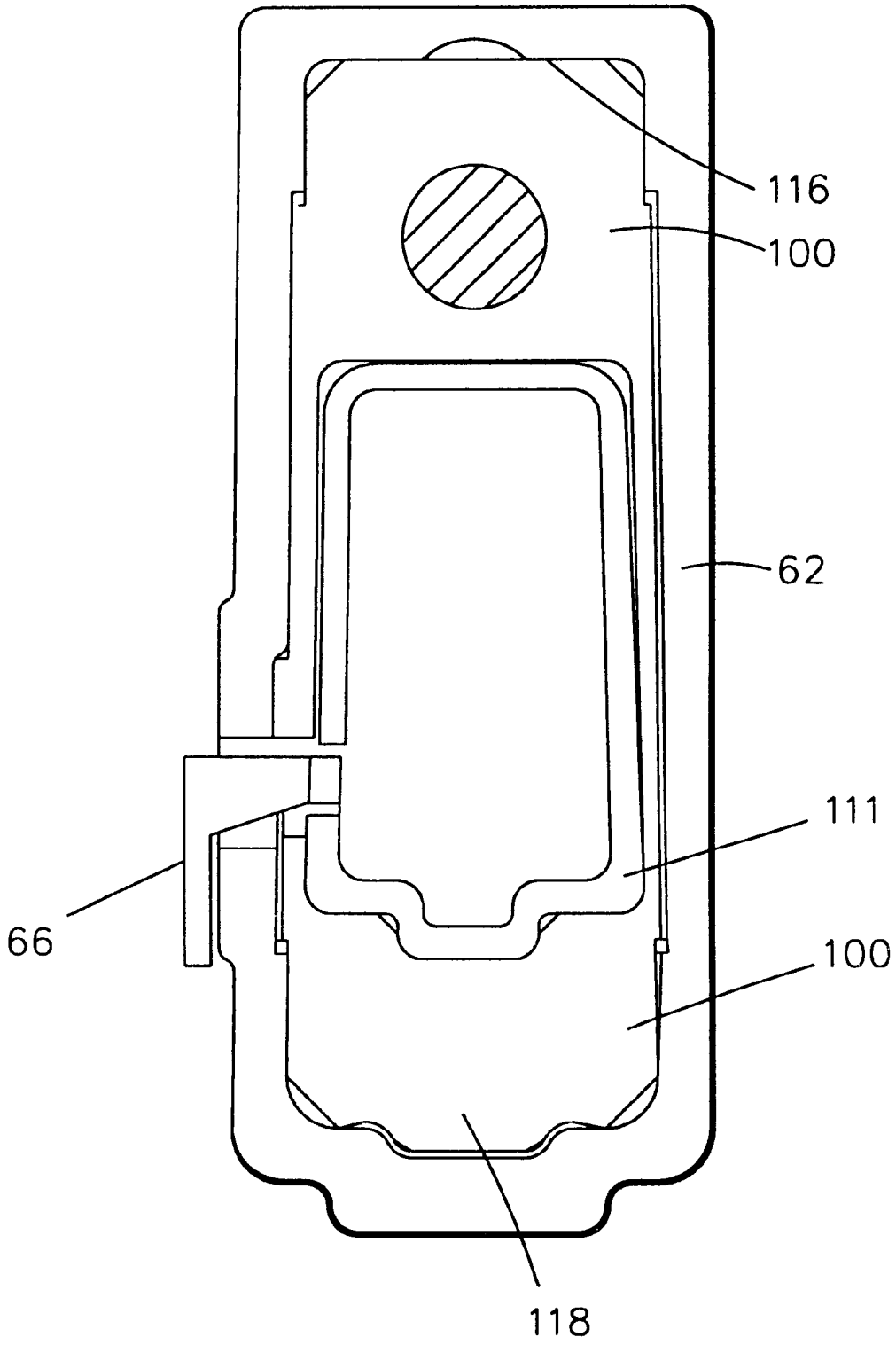
FIG. 13 is a horizontal view through the rifle receiver with an adapter and an inserted 9 mm cartridge.

As illustrated, the left side wall 114*b* includes an opening 120 which is located so as to coincide with the opening 70 in the sidewall 63 of the receiver 60 and is correspondingly sized and shaped to receive the detent 68 on the magazine catch 66 of the rifle. That is, the side wall 114*b* is of a thickness sufficiently thin to allow the detent 68 to pass completely through the opening 120 enough so to allow the detent 68 to project into a similarly placed opening in the 9 mm cartridge to effect a locked-in-place connection between the adapter 100, the 9 mm cartridge and the receiver 62. This relationship is best illustrated in FIG. 13, wherein the receiver chamber 62 is shown housing both the adapter 100 and the shorter round cartridge 111.

As best illustrated in FIGS. 7, 9 and 12*a*, 12*b*, the means 120 for securing the adapter 100 within receiver chamber 62 of the rifle 20 independently of the action of the magazine latch 66 includes a set screw 144 threadedly disposed within a threaded opening 122 formed in the front end wall 116 of the adapter body 102. The opening 122 extends generally perpendicular to the central axis CA of the adapter body and intersects at 90 degree angles with two opposed openings 124 and 126 formed in the adapter body, each communicating with the threaded opening 122 and respectively with an associated one of the side walls 114*a* and 114*b*. The opposed openings 124 and 126 are smooth and cylindrical in shape, so as to slidingly receive, respectively, first and second generally cylindrical biasing members 128 and 130, respectively associated with each of the openings 124 and 128 and further making up part of the means 120.

Figure 9:
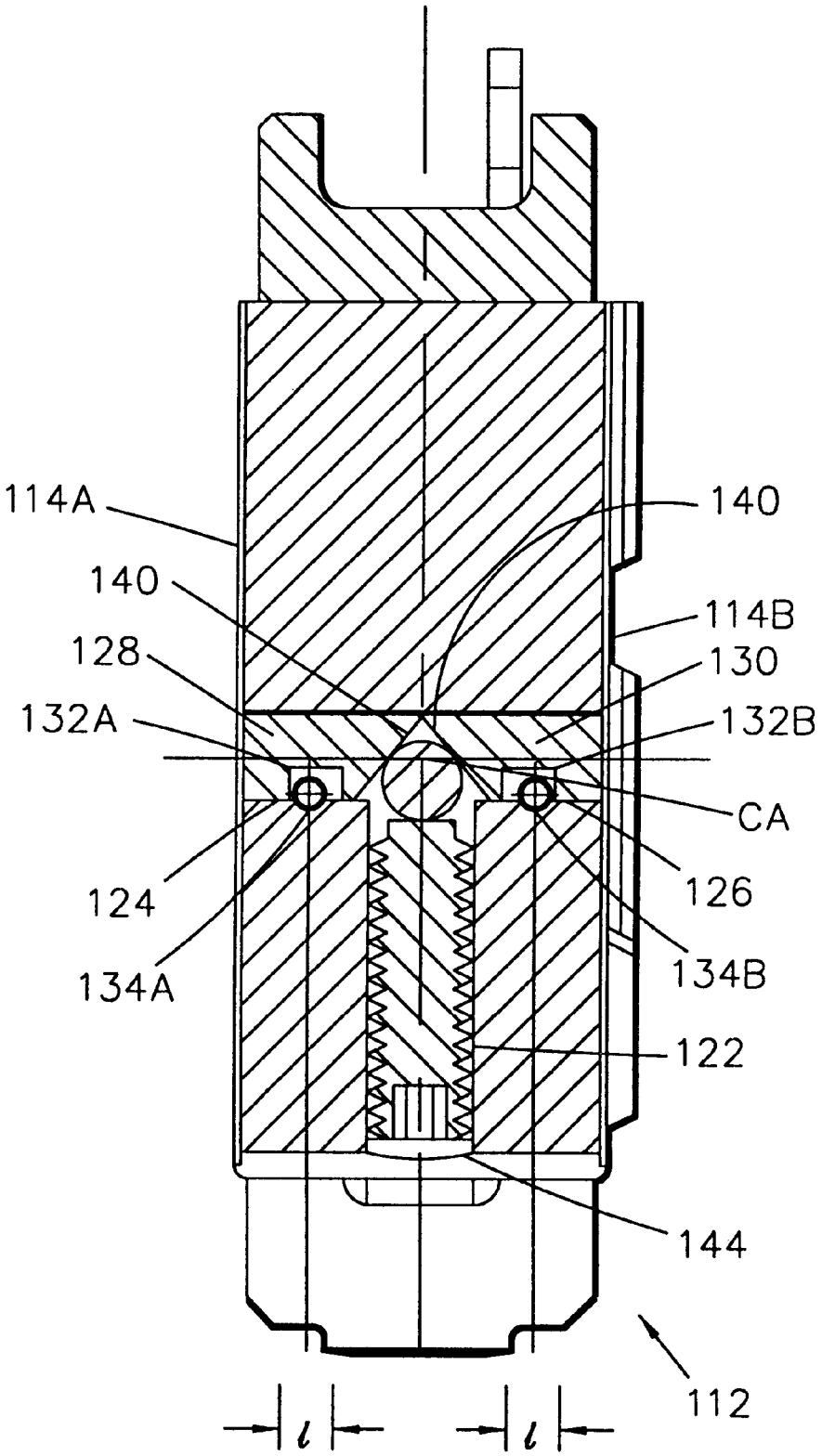
FIG. 9 is a vertical section taken along line 9—9 in FIG. 8.
Figure 10:
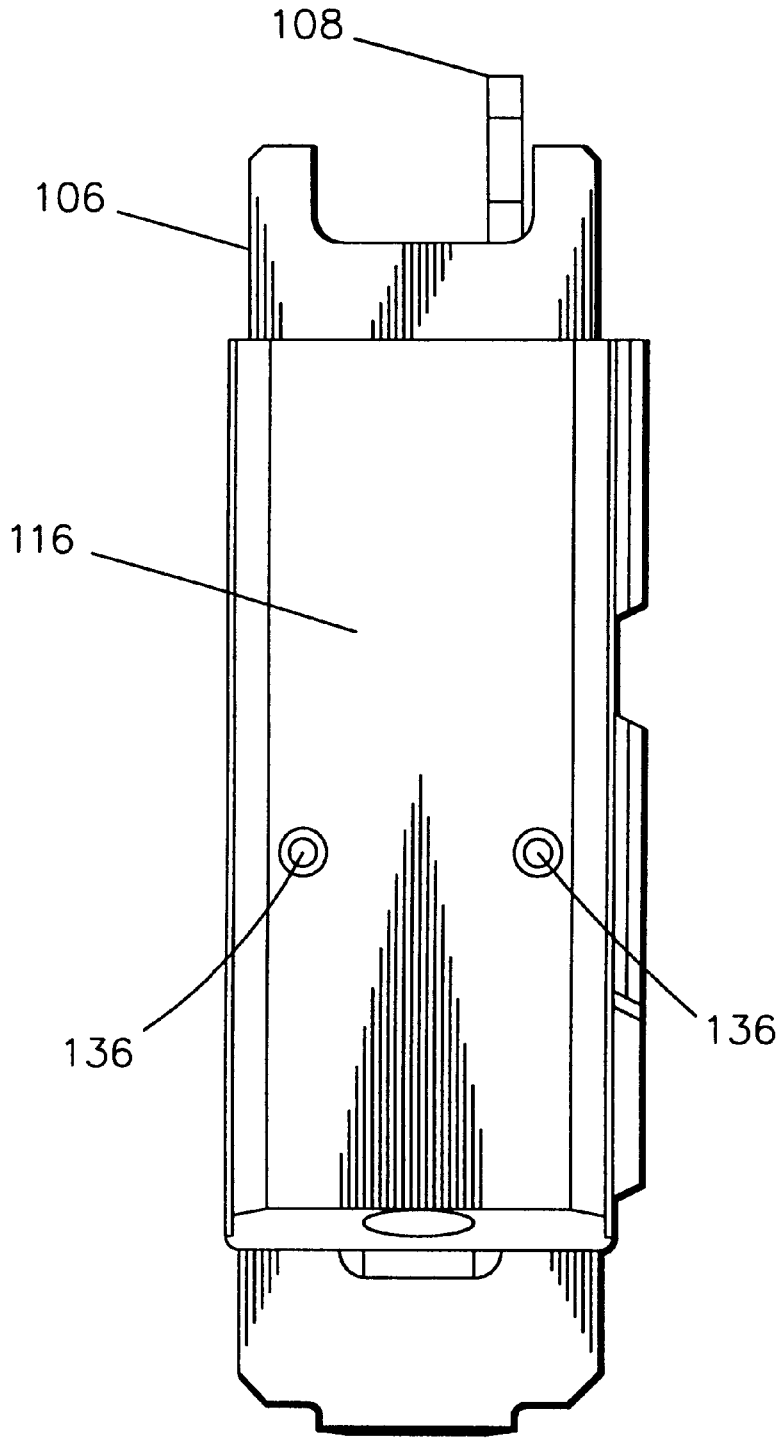
FIG. 10 is a front elevational view of the adapter.
Figure 11A:
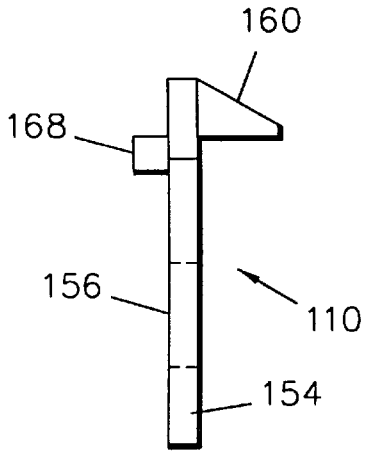
FIGS. 11*a,* 11*b,* 11*c* are front, perspective and side views of the bolt lock slidably housed within the adapter.
Figure 11B:
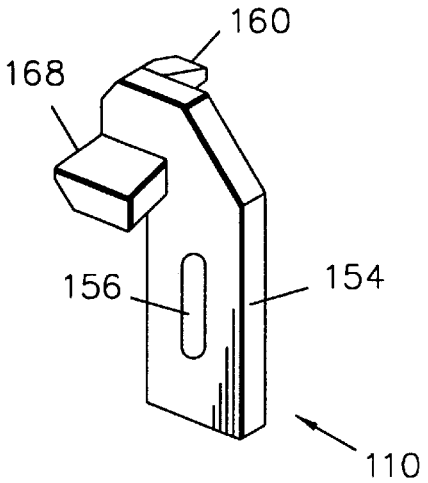
Figure 11C:
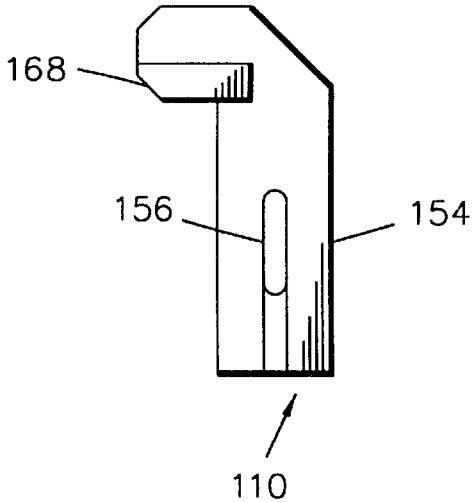
Figure 12A:
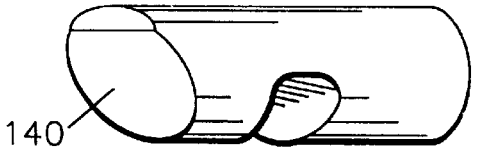
FIGS. 12*a* and 12*b* show perspective and side views of the biassing member.
Figure 12B:
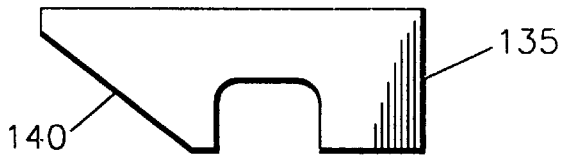

As illustrated in FIGS. 9, 12*a* and 12*b*, each of the biasing members 128 and 130 includes a cut-out 132*a* and 132*b* which corresponds positionally with a corresponding elongate groove 134*a* and 134*b* formed in the adapter body at the bottom of each opening 124 and 126 and each cutout extends perpendicularly to the longitudinal extent thereof. Each of the grooves 134*a*, 134*b* further communicates with an aligned circular opening 134*a*', 134*b*' formed through the front wall 116 of the adapter body so as to receive retaining pins 136, 136 immovably secured therein through the front end wall 116 thereof.

Figure 7:
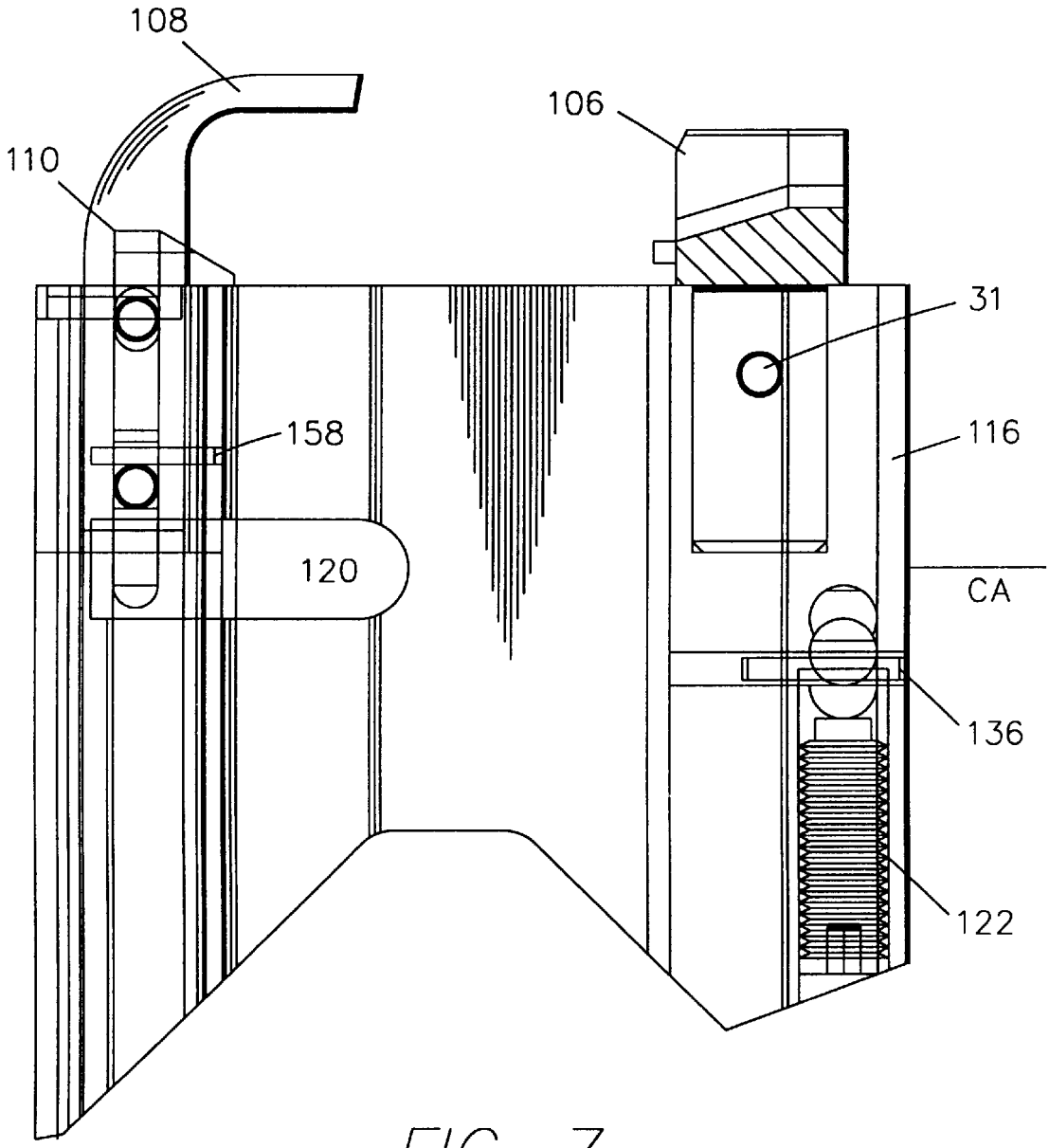
FIG. 7 is a vertical section through line 7—7 in FIG. 8 showing the securing mechanism internally housed within the adapter.

As best illustrated in FIG. 7, each of the retaining pins 136, 136 extends through respective ones of the cut-outs 132*a* and 132*b* formed in the first and second generally cylindrical biasing members 128 and 130 to limit outward lateral movement of the biasing members 128 and 130. That is, as seen in FIG. 9, each of the cut-outs 134*a* and 134*b* has a length l which is longer than the diameter of the retaining pins 136, 136 so as to allow a limited range of outward movement of the first and second generally cylindrical biasing members 128 and 130 beyond the respective right and left end walls 114*a* and 114*b*. Each biassing member 128 and 130 has an abutment wall 135 which provides a bearing surface sufficient to fictionally hold the adapter body 102 in place against the confronting inner walls of the receiver chamber 62.

As illustrated in FIGS. 9, 12*a* and 12*b*, the inward surfaces of the biasing members 128 and 130 are tapered and together form an angular inverted V-shape to present camming surfaces 140, 140 equally 45° taken from the horizontal. A ball bearing or the like spherical member 142 is located within the intersection of these openings and is biased against the surfaces 140, 140 through the intermediary of the set screw 144 which is threadedly engaged within the opening 122. Thus, the adapter 100 can be held in registration with the firing chamber 24 independently of whether the magazine catch 66 is locked in place.

That is, proper registration of the adapter 100 will automatically be set when the detent 68 of the magazine catch 66 locks into place within the latch opening 120. Once this occurs the set screw 144 can be tightened to equally bias the biasing members 128 and 130 outwardly so as to force the abutment surfaces 135, 135 against the inner surfaces of the receiver 30 and hold the adapter via friction in place irrespective of whether the magazine latch is again released or not. Thus, as illustrated in FIG. 13, the conversion cartridge illustrated generally at 111 can be received within the adapter and subsequent such magazine cartridges can be loaded or unloaded into the immovably secured adapter using the rifle magazine catch 66.

Referring now to FIGS. 4, 5, 8, and 11*a*–11*c*, and in particular to the adapter bolt catch 110, it should be seen that the adapter bolt catch 110 is received within a generally rectangular shaped recess 152 extending vertically perpendicularly to the central axis CA and transversely opening to the side wall 114*a*. As illustrated, the adapter bolt catch 110 has an elongate portion 154 which is adapted size-wise and lengthwise to be received within the correspondingly sized and shaped recess 152 in the adapter body. The bolt catch portion 154 further includes an elongated slot 156 which is correspondingly sized and shaped to received a locating pin 158 which is secured in the rear end wall 114 to limit vertical movement of the adapter bolt catch 110.

The adapter bolt catch 110 further includes a forwardly directed projection 160 which is cantilevered into the secondary receiver chamber 104 and a rearward projection 168 which is generally horizontally disposed relative to the elongate extent of the elongate portion 154. As was previously discussed with reference to FIG. 5, the rifle bolt catch 78 includes a projection 86 which is conventionally spring biased in a clockwise direction until the magazine follower rotates the stop face of the bolt catch into engagement with the bolt to prevent its further forward movement.

The rearwardly directed projection 162 has a top engagement surface 168 which sits below the rifle bolt catch projection 86 (see FIG. 5) when the adapter 100 is inserted into the receiver 62 in registration with the firing chamber 24. The adapter bolt catch 110 is thus biased downwardly by the controlling downward bias of the rifle catch spring 82 acting through the catch projection 86 situated above it. However, the adapter bolt catch 110 being vertically slidably movable relative to the adapter body 102 is caused to move upwardly once engaged by the follower of the 9 mm cartridge 111 through the intermediary of the coaction of the follower with the forwardly directed projection 160 of the adapter bolt catch 110 when the last shell is expended. That is, the spring force of the magazine cartridge being greater than that of the rifle bolt catch 82 causes adapter bolt catch 110 to be driven upwards and inturn counter rotate the rifle bolt catch 78 so as to position the rifle bolt catch stop face 90 in blocking engagement with the returning bolt to prevent it from entering the firing chamber once the last round of the cartridge has been expended. In this way, the adapter bolt catch 110 is capable of utilizing existent spring force power present within the 9 mm magazine cartridge and the existent bolt catch spring power present in the rifle to effect articulation of the bolt catch without the introduction of another powered bolt catch articulator.

By the foregoing and improved conversion adapter has been disclosed by way of the illustrated embodiment. However numerous modifications and substitutions may be had without departing from the spirit of the invention. For example, in the disclosure, reference is made to a conversion adapter for a 9 mm cartridge. However, it should be understood that such reference is made only for purposes of example, and that the adapter may be sized to receive various other length rounds which are of course shorter in length than that of the standard length rounds. Also, the disclosure makes reference to the terms front, rear, left and right to describe relationships of parts. However these terms are used simply for description.

I claim:

1. An adapter for converting a receiver of a rifle to one which receives a cartridge housing rounds of a shorter length than otherwise provided for in the rifle, said adapter comprising:

a body defined by four walls two of which walls defining front and rear walls of the adapter and two of which walls defining left and right side walls of the adapter;

each of said walls defining a secondary receiver chamber sized to receive a magazine cartridge of rounds shorter in length than otherwise provided for in a rifle;

means for cooperating with a retention catch of a rifle to effect registration of the adapter with the rifle and for allowing the magazine cartridge to be releasably connected to the adapter; and an adapter bolt catch carried by said adapter for cooperating with a rifle bolt catch of a bolt assembly of a rifle into which the adapter is used for effecting a bolt open condition by causing the rifle bolt catch to be moved into engagement with the bolt once the last of the shorted length rounds is expended.

2. An adapter as defined in claim 1 further characterized by said means for cooperating with a retention catch includes a through opening formed in one of said side walls of said adapter.

3. An adapter as defined in claim 2 further characterized by said one side wall having a thickness smaller than the length of the catch of a rifle such that a portion of the catch extends through said one of said side walls and into said secondary receiver chamber.

4. An adapter as defined in claim 3 further characterized by means associated with said means for cooperating with said retention catch for independently securing the adapter in place within said receiver such that when the magazine retention catch of a rifle is moved out of said through opening of said adapter, the adapter is still held in place and maintained in its original registration with the rifle.

5. An adapter as defined in claim 4 further characterized by said securing means includes a pair of biassing members housed partially within the front wall of said adapter and being movable outwardly to positions extending beyond said right and left side walls by a internal biasing means housed within said front wall.

6. An adapter as defined in claim 5 further characterized by said internal biasing means including a threaded opening formed within said front wall extending parallel thereto and intersecting perpendicularly transverse openings in which are housed each of said biassing members, and wherein said threaded opening receiving a threaded member therein.

7. An adapter as defined in claim 6 further characterized by said threaded member having a portion on which threaded surfaces are formed and an upper portion engageable with a ball member, each of said biassing members having a tapered surface in engagement with said ball member to equally distribute a holding force to said biassing members.

8. An adapter as defined in claim 7 further characterized by said adapter being formed from a metallic extrusion such that each said four side walls is integrally formed with one another.

9. An adapter as defined in claim 1 further characterized by said adapter including an adapter bolt catch received slidably within a generally rectangular shaped recess extending vertically perpendicularly to a central axis of the adapter.

10. An adapter as defined in claim 9 further characterized by said adapter bolt catch has an elongate portion which is adapted sizewise and lengthwise to be received within the rectangular shaped recess in the adapter.

11. An adapter as defined in claim 10 further characterized by said adapter bolt catch has an elongate slot which is correspondingly sized and shaped to received a locating pin which is secured into the rear end wall of the adapter to limit vertical movement of the adapter bolt catch.

12. An adapter as defined in claim 11 further characterized by said adapter bolt catch further includes a forwardly directed projection which is cantilevered into the secondary receiver chamber and a rearwardly projection having a engagement surface which is generally horizontally disposed relative to the elongate extent of the elongate portion.

13. An adapter for converting a receiver of a rifle to one which receives a cartridge housing rounds of a shorter length than otherwise provided for in the rifle, said adapter comprising:

a body defined by four walls two of which walls defining front and rear walls of the adapter and two of which walls defining left and right side walls of the adapter;

each of said walls defining a secondary receiver chamber sized to receive a magazine cartridge of rounds shorter in length than otherwise provided for in a rifle;

means for cooperating with a retention catch of a rifle to effect registration of the adapter with the rifle and for allowing the magazine cartridge to be releasably connected to the adapter; and means associated with said means for cooperating with said retention catch for independently securing the adapter in place within said receiver such that when the magazine retention catch of a rifle is released, the adapter is still held in place and maintained in its original registration with the rifle.

14. An adapter as defined in claim 13 further characterized by said securing means includes a pair of biassing members housed partially within the front wall of said adapter and being movable outwardly to positions extending beyond said right and left side walls by an internal biasing means housed within said front wall.

15. An adapter as defined in claim 14 further characterized by said internal biasing means including a threaded opening formed within said front wall extending parallel thereto and intersecting perpendicularly transverse openings in which are housed each of said biassing members, and wherein said threaded opening receiving a threaded member therein.

16. An adapter as defined in claim 15 further characterized by said threaded member having a portion on which threaded surfaces are formed and an upper portion engageable with a ball member, each of said biassing members having a tapered surface in engagement with said ball member to equally distribute a holding force to said biassing members.

17. An adapter as defined in claim 16 further characterized by said adapter being formed from a metallic extrusion such that each said four side walls is integrally formed with one another.

18. An adapter as defined in claim 13 further characterized by an adapter bolt catch carried by said adapter for cooperating with the rifle bolt catch of a bolt assembly of a rifle into which the adapter is used for effecting a bolt open condition by causing the rifle bolt catch to be moved into blocking engagement with the bolt once the last of the shortened length rounds is expended.

* * * * *